US010106923B2

(12) United States Patent
Hosoya et al.

(10) Patent No.: US 10,106,923 B2
(45) Date of Patent: Oct. 23, 2018

(54) EXTRA-FINE FIBER SHEET

(71) Applicant: KURARAY CO., LTD., Kurashiki-shi (JP)

(72) Inventors: Takayoshi Hosoya, Fujisawa (JP); Tomohiro Hayakawa, Okayama (JP); Hiroyuki Kawai, Okayama (JP); Hideo Hayashi, Okayama (JP)

(73) Assignee: KURARAY CO., LTD., Kurashiki-shi (JP)

( * ) Notice: Subject to any disclaimer, the term of this patent is extended or adjusted under 35 U.S.C. 154(b) by 710 days.

(21) Appl. No.: 14/227,557

(22) Filed: Mar. 27, 2014

(65) Prior Publication Data

US 2014/0213135 A1 Jul. 31, 2014

Related U.S. Application Data

(63) Continuation of application No. PCT/JP2012/073815, filed on Sep. 18, 2012.

(30) Foreign Application Priority Data

Sep. 28, 2011 (JP) ..... 2011-212471

(51) Int. Cl.
*D04H 3/016* (2012.01)
*D04H 1/728* (2012.01)
*D04H 1/4382* (2012.01)

(52) U.S. Cl.
CPC ..... *D04H 3/016* (2013.01); *D04H 1/4382* (2013.01); *D04H 1/728* (2013.01); *Y10T 442/615* (2015.04)

(58) Field of Classification Search
CPC ..... D04H 1/728
(Continued)

(56) References Cited

U.S. PATENT DOCUMENTS

2002/0100725 A1 8/2002 Lee et al.
2003/0215624 A1* 11/2003 Layman ..... A61L 27/50 428/221

(Continued)

FOREIGN PATENT DOCUMENTS

CN 103301755 9/2013
JP 2002-249966 9/2002

(Continued)

OTHER PUBLICATIONS

Spasova, Mariya et al., "Perspectives On: Criteria for Complex Evaluation of the Morphology and Alignment of Electrospun Polymer Nanofibers", Sep. 1, 2006, Journal of Bioactive and Compatible Polymers, vol. 21, issue 5, pp. 465-479.*

(Continued)

*Primary Examiner* — Peter Y Choi
(74) *Attorney, Agent, or Firm* — Oblon, McClelland, Maier & Neustadt, L.L.P.

(57) ABSTRACT

Provided is an extra-fine fiber sheet including an extra-fine fiber assembly including extra-fine fibers having an average fiber diameter of 500 nm or smaller. The extra-fine fiber sheet includes an extra-fine fiber assembly. The assembly includes a solvent-spinnable polymer (A) having a weight average molecular weight of 5,000 to 100,000 as a main component and a polymer (B) having a weight average molecular weight equal to or more than 10 times as large as that of the polymer (A) as an accessory component; and the assembly includes constituent fibers having an average fiber diameter of 10 to 500 nm. The polymer (A) may be a non-conductive polymer, and the polymer (B) may be a thickening polymer.

13 Claims, 1 Drawing Sheet

(58) Field of Classification Search
USPC ..... 442/341
See application file for complete search history.

(56) References Cited

U.S. PATENT DOCUMENTS

| | | | | |
|---|---|---|---|---|
| 2008/0241538 | A1 | 10/2008 | Lee et al. | |
| 2009/0081457 | A1* | 3/2009 | Nagarajan | D01D 5/003 428/401 |
| 2011/0309014 | A1 | 12/2011 | Hosoya et al. | |
| 2012/0021026 | A1* | 1/2012 | Glenn, Jr. | A61K 9/70 424/401 |
| 2012/0164514 | A1* | 6/2012 | Hayakawa | H01M 2/145 429/144 |

FOREIGN PATENT DOCUMENTS

| | | | |
|---|---|---|---|
| JP | 2006-233355 | | 9/2006 |
| JP | 2008-002037 | | 1/2008 |
| JP | 2009-006622 | | 1/2009 |
| JP | 2009-041117 | | 2/2009 |
| JP | 2009-41117 | | 2/2009 |
| JP | 2009-0411117 | | 2/2009 |
| JP | 2009-114560 | A | 5/2009 |
| JP | 2009-150005 | | 7/2009 |
| JP | 2009-233550 | | 10/2009 |
| JP | 2010-275665 | | 12/2010 |
| JP | WO 2011033975 | A1 * | 3/2011 ..... H01M 2/145 |
| WO | WO 2010/073958 | A1 | 7/2010 |

OTHER PUBLICATIONS

Japanese Office Action dated Nov. 24, 2015 in Patent Application No. 2013-536187 (with Partial English Translation).

Hiroshi Seo et al., "Preparation of Polysaccharide Nanofiber Fabrics by Electrospray Deposition: Additive Effects of Poly(ethylene Oxide)", Polymer Journal, The Society of Polymer Science, vol. 37, No. 6, Jun. 15, 2005, pp. 391-398.

Supplemental European Search Report dated Jun. 11, 2015 in connection with corresponding European Patent Application No. 12 83 6568, filed Sep. 18, 2012.

First Chinese Office Action dated Jul. 3, 2015 in connection with corresponding Chinese Patent Application No. 201280046600.0, filed Sep. 18, 2012.

International Search Report dated Dec. 18, 2012 in PCT/JP2012/073815 filed Sep. 18, 2012.

English translation of the International Preliminary Report on Patentability and Written Opinion dated Apr. 10, 2014 in PCT/JP2012/073815.

Korean Office Action dated Jun. 18, 2018 in Patent Application No. 10-2014-7008744 (with English translation), 10 pages.

* cited by examiner

EXTRA-FINE FIBER SHEET

CROSS REFERENCE TO THE RELATED APPLICATION

This application is a continuation application, under 35 U.S.C. § 111(a), of international application No. PCT/JP2012/073815, filed Sep. 18, 2012, which claims priority to Japanese Patent Application No. 2011-212471 filed on Sep. 28, 2011 in Japan, the entire disclosure of which is herein incorporated by reference as a part of this application.

TECHNICAL FIELD

The present invention relates to a sheet including an extra-fine fiber assembly including fibers having an average fiber diameter of 500 nm or smaller.

BACKGROUND ART

A sheet comprising a fiber assembly, typically a nonwoven fabric, which includes extra-fine fibers having a fiber diameter of nanometer size to micrometer size, has been used in a wide range of applications such as those of separators or electrolyte membranes of lithium secondary batteries, separators of fuel batteries, filters and medical fields.

As a method for preparing a fiber assembly including extra-fine fibers having a fiber diameter of nanometer size, an electro-spinning method is known (see, for example, Patent Document 1). In this method, when a polymer solution or a polymer melt is extruded from a spinning nozzle, a high voltage is applied between the spinning nozzle and a counter electrode to accumulate charges in a dielectric material in the nozzle, thereby producing extra-fine fibers by means of an electrostatic repulsive force. In Patent Document 1, by using a highly volatile solvent as a solvent or by elevating a temperature of a polymer solution, the viscosity of the polymer solution is reduced without significantly reducing the concentration of the polymer so as to suppress thickening of fibers.

Patent Document 2 discusses to obtain a sheet including a nonwoven fiber assembly in a fabric shape by electro-spinning a spinning dope which is prepared from a fiber-formable organic polymer in addition to a proton conductive polymer (see, for example, Patent Document 2).

PRIOR ART DOCUMENTS

Patent Documents

Patent Document 1: Japanese Patent Laid-open Publication No. 2002-249966

Patent Document 2: Japanese Patent Laid-open Publication No. 2006-233355

SUMMARY OF THE INVENTION

Problems to be Solved by the Invention

However, since the concentration of the polymer solution should be kept somewhat high with the electro-spinning method of Patent Document 1, the fineness of fibers constituting a web cannot be reduced. Although Patent Document 1 describes that fibers have diameters of from several nanometers to several thousands nanometers, it is impossible to make the average fiber diameter in the web that small.

Further, Patent Document 2 is vague about whether fibers can have a small fineness or not probably because use of a specific proton conductive polymer is essential. Although this document describes that the average fiber diameter of fibers constituting a nonwoven fabric is 3 μm or smaller, as is apparent from Examples, the average fiber diameter of fibers constituting the actually produced fiber structure is around 1 μm, and a further small fineness cannot be achieved.

An object of the present invention is to provide an extra-fine fiber sheet which can achieve previously unattainable small fineness and which comprises a fiber assembly including extra-fine fibers having an average fiber diameter of 500 nm or smaller.

Another object of the present invention is to provide an extra-fine fiber sheet which can achieve small fineness even when a polymer having low fiber formability is used.

Still another object of the present invention is to provide an extra-fine fiber sheet excellent in liquid absorbability and peel resistance.

Another object of the present invention is to provide an extra-fine fiber sheet excellent in straightness of extra-fine fibers constituting the extra-fine fiber sheet.

Solutions to the Problems

The present inventors have conducted extensive studies for achieving the objects described above, and with an attention given to the molecular weight of a polymer used at the time of performing electro-spinning, found as a problem that (i) in order to achieve further small fineness, it is necessary to reduce the molecular weight of a polymer that forms a spinning dope, (ii) but, when a low-molecular-weight polymer having a weight average molecular weight of 100,000 or lower is used, a polymeric nodule called a "bead" is easily generated when electro-spinning is performed, so that it is difficult to produce extra-fine fibers of nanometer size. In the process for solving the above problem, the present inventors have further found that (iii) when such a low-molecular-weight polymer is subjected to electro-spinning in combination with a high-molecular-weight polymer having a specific molecular weight relationship with the low-molecular-weight polymer as an accessory component, an extra-fine fiber sheet comprising previously unattainable extra-fine fibers can be obtained. With these findings, the present inventors have accomplished the present invention.

That is, the present invention provides an extra-fine fiber sheet comprising an extra-fine fiber assembly, wherein the assembly includes a solvent-spinnable polymer (A) having a weight average molecular weight of 5,000 to 100,000 as a main component and a polymer (B) having a weight average molecular weight equal to or more than 10 times as large as that of the polymer (A) as an accessory component; and the assembly comprises constituent fibers having an average fiber diameter of 10 to 500 nm.

In the extra-fine fiber sheet, the polymer (A) may be a low-conductive or non-conductive polymer, and/or the polymer (B) may be a thickening polymer. The extra-fine fiber sheet may have a composition ratio of the polymer (A) to the polymer (B) of (A): (B)=about 10:1 to 10,000:1.

Preferably, the polymer (A) may be (i) an ethylene-vinyl alcohol copolymer or (ii) a polyamide including a 1,9-nonanediamine unit and/or a 2-methyl-1,8-octanediamine unit as a diamine unit. More specifically, the polyamide may be a polyamide including a dicarboxylic acid unit and a diamine unit, wherein the dicarboxylic acid unit comprising terephthalic acid unit at a percentage of 60% by mole or more, and the diamine unit comprising 1,9-nonanediamine unit and/or 2-methyl-1,8-octanediamine unit at a percentage of 60% by mole or more.

On the other hand, preferably the polymer (B) may be a polyethylene oxide, a polyethylene glycol or a polyacrylamide. Particularly, the polymer (B) has a weight average molecular weight of the polymer (B) of preferably 500,000 or higher.

The extra-fine fiber assembly is excellent in straightness of constituent fibers, and for example, the assembly has 5 or less bead-like structure generated per 100 $\mu m^2$ on a cross section of the extra-fine fiber assembly photographed at a magnification of 5,000.

Such an extra-fine fiber assembly can be obtained by an electro-spinning method.

Any combination of at least two constitutional elements disclosed in Claims and/or Description is included in the present invention. Particularly, any combination of at least two or more claims described in Claims is included in the present invention.

Effects of the Invention

According to the present invention, even with a polymer having a low molecular weight, a sheet including extra-fine fibers having an average fiber diameter of 500 nm or smaller can be obtained by adding a polymer having a specific molecular weight relationship with the low-molecular-weight polymer.

In one embodiment of the present invention, an extra-fine fiber sheet which can achieve small fineness can be obtained even when a polymer having low fiber spinnability is used.

In another embodiment of the present invention, an extra-fine fiber sheet which is not only capable of quickly absorbing a liquid but also excellent in peel resistance can be obtained.

In still another embodiment of the present invention, an extra-fine fiber sheet including straight constituent fibers can be obtained by suppressing generation of a bead-shaped globule in extra-fine fibers that form the extra-fine fiber sheet.

BRIEF DESCRIPTION OF THE DRAWINGS

The present invention will be understood more clearly from the preferred embodiments described below with reference to the attached drawings. However, the embodiments and drawings are merely illustrative and explanatory, and should not be used to define the scope of the present invention. The scope of the present invention is defined by the appended claims.

EMBODIMENTS OF THE INVENTION

[Extra-Fine Fiber Sheet]

Figure 1:
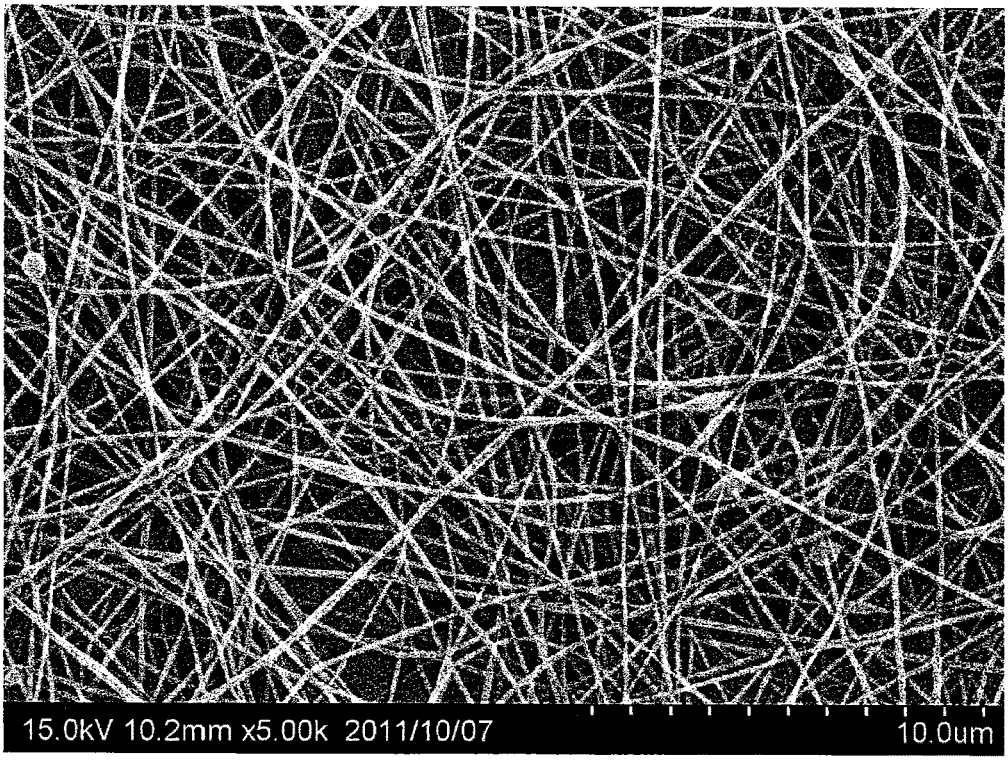
FIG. 1 is a scanning electron microscope photograph (magnification: 5,000) of an extra-fine fiber sheet obtained in Example 1.

An extra-fine fiber sheet according to the present invention includes an extra-fine fiber assembly. The assembly includes a solvent-spinnable polymer (A) having a weight average molecular weight of 5,000 to 100,000 as a main component and a polymer (B) having a weight average molecular weight equal to or more than 10 times as large as that of the polymer (A) as an accessory component; and the assembly comprises constituent fibers having an average fiber diameter of 10 to 500 nm.

As one aspect, the extra-fine fiber assembly may have an average fiber diameter of preferably 400 nm or smaller, more preferably 300 nm or smaller, especially preferably 250 nm or smaller because the extra-fine fiber assembly can have previously unattainable small fineness while it includes straight fibers in which generation of beads is suppressed.

It should be noted, in this specification, that the "bead" is an unfiberized particulate material called as "bead" specific to electro-spinning method, and the term "bead" means a nodulous part having a thickness equal to or more than 5 times as large as an average fiber diameter.

In the extra-fine fiber assembly according to the present invention, the number of bead-like structure generated per 100 $\mu m^2$ on a cross section of the fiber assembly photographed at a magnification of 5,000 with a scanning electron microscope can be reduced to, for example, 5 or less, preferably 4 or less, more preferably 3 or less, further preferably 2 or less, especially preferably 1 or less.

The extra-fine fiber assembly according to the present invention includes extra-fine fibers having a small fineness and a straight shape, so that a liquid can be quickly absorbed into the fiber sheet. For example, when a drop (0.02 mL) of pure water is placed onto the center of a 3 cm square sheet on the extra-fine fiber assembly side, the extra-fine fiber sheet may absorb a liquid therein in a rate of 700 seconds or less, preferably 600 seconds or less.

[Polymer (A)]

In the present invention, the polymer (A) is a low-molecular polymer having a weight average molecular weight of 10,000 or lower, and for example, the weight average molecular weight thereof may be 5,000 to 100,000, preferably 8000 to 90,000, or may be 10,000 to 100,000, preferably 10,000 to 80,000.

In the present invention, since the polymer (A) is a low-molecular-weight polymer, even when the polymer (A) is also a low-conductive or non-conductive polymer, a sheet including extra-fine fibers having small fineness can be obtained by using electro-spinning method.

The polymer (A) is not particularly limited to a specific one as long as an extra-fine fiber sheet having the above-mentioned average fiber diameter can be obtained. The polymer (A) may be preferably an ethylene-vinyl alcohol copolymer, a polyamide comprising a dicarboxylic acid unit and a diamine unit, or others.

The ethylene-vinyl alcohol copolymer to be used for the polymer (A) in the present invention may be composed of a saponified product of a copolymer of ethylene and vinyl acetate. The percentage of ethylene unit in the copolymer may be 25 to 70% by mole from the viewpoint of morphological stability in water. When a polymer has ethylene unit at a percentage of less than 25% by mole, there may be a problem that fibers formed from such a polymer stick to one another due to easily dissolvable nature of the fibers in water. On the other hand, when a polymer has ethylene unit at a percentage of more than 70% by mole, there may be a problem that heat resistance of fiber is deteriorated because such a polymer gives low-melting-point fibers having a melting point of 120° C. or lower. The preferable percentage of ethylene unit may be 30 to 50% by mol.

The ethylene-vinyl alcohol copolymer to be used as the polymer (A) in the present invention may have a saponification degree of preferably 80% by mole or more, and further preferably 98% by mole or more. The ethylene-vinyl alcohol copolymer having a saponification degree of less than 80% by mole may not be preferable from the viewpoint of strength-related properties of extra-fine fibers of the polymer because the degree of crystallinity of the ethylene-vinyl alcohol copolymer is decreased.

The polyamide to be used as the polymer (A) in the present invention is preferably a polyamide comprising a dicarboxylic acid unit and a diamine unit, the dicarboxylic acid unit comprising terephthalic acid unit at a percentage of 60% by mole or more, and the diamine unit comprising 1,9-nonanediamine unit and/or 2-methyl-1,8-octanediamine unit at a percentage of 60% by mole or more in total.

In the case where the polyamide has other dicarboxylic acid unit(s) in combination with terephthalic acid unit, examples of other dicarboxylic acid unit may include dicarboxylic acid units derived from, for example, aromatic dicarboxylic acids such as isophthalic acid, 2,6-naphthalenedicarboxylic acid, 2,7-naphthalenedicarboxylic acid, 1,4-naphthalenedicarboxylic acid, 1,4-phenylenedioxanediacetic acid, 1,3-phenylenedioxanediacetic acid, diphenic acid, dibenzoic acid 4,4'-oxydibenzoic acid, diphenylmethane-4,4'-dicarboxylic acid, diphenylsulfone-4,4'-dicarboxylic acid and 4,4'-biphenyldicarboxylic acid; aliphatic dicarboxylic acids such as malonic acid, dimethylmalonic acid, succinic acid, 3,3-diethylsuccinic acid, glutaric acid, 2,2-dimethylglutaric acid, adipic acid, 2-methyladipic acid, trimethyladipic acid, pimellic acid, azelaic acid, sebacic acid and suberic acid; alicyclic dicarboxylic acids such as 1,3-cyclopentanedicarboxylic acid and 1,4-cyclohexanedicarboxylic acid. The polyamide may comprise the above dicarboxylic acid unit(s) singly or in combination of two or more.

If necessary, the polyamide used for the polymer (A) may further comprise structural units derived from polybasic carboxylic acids such as trimellitic acid, trimesic acid and pyromellitic acid as long as the polyamide extra-fine fibers as described above can be formable.

Among them, the percentage of the aromatic dicarboxylic acid unit in the total dicarboxylic acid units constituting polyamide is preferably 75% by mole or more, especially preferably 100% by mole.

In the case where polyamide has other diamine unit(s) in combination with 1,9-nonanediamine unit and/or 2-methyl-1,8-octanediamine unit, examples of other diamine unit may include diamine units derived from, for example, alkylenediamines having 6 to 12 carbon atoms other than 1,9-nonanediamine and 2-methyl-1,8-octanediamine units, specifically alkylenediamines having 6 to 12 carbon atoms such as 1,6-hexanediamine, 1,8-octanediamine, 1,10-decanediamine, 1,11-undecanediamine, 1,12-dodecanediamine, 2-methyl-1,5-pentanediamine, 3-methyl-1,5-pentanediamine, 2,2,4-trimethyl-1,6-hexanediamine, 2,4,4-trimethyl-1,6-hexanediamine, and 5-methyl-1,9-nonanediamine; diamines other than above-mentioned alkylenediamines having 6 to 12 carbon atoms, specifically aliphatic diamines such as ethylenediamine and 1,4-butanediamine; alicyclic diamines such as cyclohexanediamines, methylcyclohexanediamines, isophoronediamines, and norbornanedimethyldiamines, tricyclodecanedimethyldiamines; aromatic diamines such as p-phenylenediamines, m-phenylenediamines, xylylenediamines, xylenediamines, 4,4'-diaminodiphenylmethane, 4,4'-diaminodiphenylsulfone, and 4,4'-diaminodiphenyl ether. The polyamide may comprise the diamine unit(s) singly or in combination of two or more.

The polyamide (a) used in the polymer (A) for the present invention preferably comprises an alkylenediamine having 6 to 12 carbon atoms including 1,9-nonanediamine unit and 2-methyl-1,8-octanediamine unit at a percentage of 75% by mole or more, and particularly preferably 90% by mole or more, based on the total amount of diamine units.

Moreover, in the polyamide, the molar ratio of amide unit (—CONH—) relative to methylene unit (—$CH_2$—) in the polyamide molecular chain, i.e., [(—CONH—)/(—$CH_2$—)] is preferably in the range of ½ to ⅛, particularly preferably of ⅓ to ⅕.

The polymer (B) usually has a weight average molecular weight of 100,000 or lower, in particular preferably of 8,000 to 20,000.

By dissolving the polymer (A) in a solvent so as to prepare a spinning dope, such a spinning dope is producible of extra-fine fibers. When an ethylene-vinyl copolymer is allowed to be dissolved in a solvent, the ethylene-vinyl copolymer is dissolved in a solvent such as dimethyl sulfoxide (DMSO) or a mixture of water and a lower alcohol (e.g., methyl alcohol, ethyl alcohol, or 1-propannol) to provide a spinning dope of an ethylene-vinyl copolymer solution.

On the other hand, when the polyamide used in the present invention is allowed to be dissolved in an organic solvent to prepare a spinning dope for electro-spinning, any of organic solvents capable of dissolving the polyamide can be used as the organic solvent for the spinning dope. Examples of such solvents include protonic polar solvents such as hexafluoroisopropanol (HFIP), phenol, cresol, concentrated sulfuric acid, formic acid, and others; non-protonic polar solvents such as N-methylpyrrolidone (NMP), dimethyl sulfoxide (DMSO), dimethyl acetoamide (DMAc), and others. Among them, as the organic solvents, hexafluoroisopropanol or formic acid is preferably used from the viewpoint of stability of spinning dope.

However, since the ethylene-vinyl alcohol copolymer or the polyamide used in the present invention is a low-molecular-weight polymer having a weight average molecular weight of 100,000 or lower as described above, when a spinning dope prepared by dissolving such a polymer solely in a solvent to produce a sheet comprising fibers having an average fiber diameter of 500 nm or smaller, the obtained sheet has a significantly impaired quality such as an external appearance because generation of "beads" is remarkable in the sheet.

Thus, the present inventors have conducted extensive studies, and resultantly found that when a spinning dope including a polymer (A) and further a small amount of a polymer (B) having a weight average molecular weight equal to or more than 10 times as large as that of the polymer (A), a sheet including fibers having an average fiber diameter of 500 nm or smaller is obtained.

[Polymer (B)]

The polymer (B) to be used in the present invention has a weight average molecular weight of equal to or more than 10 times as large as that of the polymer (A) in order to improve the spinning ability of the polymer (A) for forming extra-fine fibers. Examples of the preferred polymer (B) include a polymer having thickening property, such as synthetic thickening polymers (e.g., a polyethylene oxide, an ethylene oxide-propylene oxide copolymer, a polyethylene glycol and a polyacrylamide), a thickening cellulose derivative (e.g., a hydroxyethyl cellulose and a hydroxypropyl cellulose), and the like. Among them, a polyethylene oxide, a polyethylene glycol or a polyacrylamide is especially preferable from the viewpoint of intimate mixing and compatibilization with the ethylene-vinyl alcohol copolymer or polyamide.

In the case where the polymer (B) has a weight average molecular weight of less than 10 times as large as that of the polymer (A), addition of a small amount of the polymer (B) does not result in achievement of a sufficient fiber spinning property even by intimately mixing the polymers, and therefore the problem of generation of "beads" cannot be not solved. The weight average molecular weight of the polymer (B) is preferably 30 times or more (e.g., 30 to 500 times), more preferably 50 times or more (e.g., 30 to 300 times) as large as that of the polymer (A).

Further, in the extra-fine fiber sheet of the present invention, the sheet has a composition ratio (weight solid content ratio) of the polymer (A) having a weight average molecular weight of 100,000 or lower relative to the polymer (B) having a weight average molecular weight equal to or more than 10 times as large as that of the polymer (A) of preferably (A):(B)=10:1 to 10,000:1. An excessively small composition ratio of the polymer (A) is not preferable because physical properties of the polymer (B) such as a polyethylene oxide or a polyethylene glycol are reflected in physical properties of the ethylene-vinyl alcohol copolymer, leading to a change in properties such as solubility and melting point. On the other hand, an excessively large composition ratio of the polymer (A) is not preferable because the amount of the polymer (B) to be added is too low to achieve a sufficient fiber spinning property, so that generation of beads is not eliminated. The composition ratio is more preferably 10:1 to 9000:1, further preferably 10:1 to 8000:1. In a preferable embodiment, higher the ratio of the polymer (B) is, more excellent in liquid absorbability and peel resistance the sheet is.

In the present invention, the weight average molecular weight of polyethylene oxide, polyethylene glycol or polyacrylamide constituting the polymer (B) is preferably 500,000 or higher (e.g., about 800,000 to 6,000,000), more preferably 1,000,000 or higher (e.g., about 1,000,000 to 5,000,000) for achieving a sufficient fiber spinning property when the polymer (B) is added in such a small amount that physical properties of the polymer (A) are not changed.

The extra-fine fibers of the present invention can be obtained by preparing a spinning dope under the above-mentioned conditions and discharging the dope from a nozzle by electro-spinning method to form fibers.

[Method for Producing Extra-Fine Fiber Sheet]

A method for producing an extra-fine fiber sheet according to the present invention may comprise:

preparing a spinning dope including a solvent-spinnable polymer (A) having a weight average molecular weight of 1 to 100,000 as a main component and a polymer (B) having a weight average molecular weight equal to or more than 10 times as large as that of the polymer (A) as an accessory component to be mixed in a solvent; and spinning the spinning dope by electro-spinning method to form an extra-fine fiber sheet. By the above-described production method, an extra-fine fiber sheet can be efficiently produced.

More specifically, in the sheet forming step, by applying a high voltage to an electrically conductive member that supplies the spinning dope, the spinning dope discharged from a nozzle is electric-charged and split into droplets. Thereafter, by the action of the electrical field, continuous fibrous materials are drawn (spun) from a point of an electric-charged droplet, and a large number of divided fibrous materials are spread in a continuous state, and deposited on an earthed counter electrode side, so that a sheet-shaped layer(s) of extra-fine fibers can be collected or deposited. Even if the concentration of the polymer in the solution is 10% or lower, the solvent is easily evaporated during filament formation process as well as thinning process; and the spun filaments are deposited on a collecting belt or on a base material positioned at the distance from the nozzle in a range between several centimeters and several tens of centimeters. While being deposited, the slight bonding of the deposited extra-fine fibers containing a solvent can be formed at their crossover points with each other. As a result, the fiber movement among fibers can be avoided, and new fine fibers are sequentially deposited, so that a dense sheet of continuous fibers can be obtained. A nonwoven fabric or woven fabric as a base material may be placed on the collecting surface so as to allow extra-fine fibers to be deposited thereon to form a laminate. The average fiber diameter of extra-fine single fibers can be controlled to a predetermined average fiber diameter by conditions such as a concentration of the dope of the polymer, a distance between the nozzle and the sheet collecting surface (distance between electrodes) and a voltage applied to the nozzle.

As described above, the layer(s) of extra-fine fibers may be deposited directly on the collection belt; alternatively they may also be deposited on a base material for reinforcing the strength of the extra-fine fiber layer. When the extra-fine fiber layer is deposited on the base material, the extra-fine fiber sheet includes a base material layer together with the extra-fine fiber layer. As the base material being capable of constituting the fiber sheet in the present invention, there may be mentioned a nonwoven fabric or a woven fabric with a single fiber average fiber diameter of 1 μm or larger. When the average fiber diameter of single fibers is smaller than 1 μm, the tensile strength of the sheet is reduced, resulting in deterioration not only in processability during processability, but also in durability as of the sheet. The average single fiber diameter of fibers constituting the base material is required to be 1 μm or larger as described above, but is preferably 5 μm or larger, further preferably 7 μm or larger. As an upper limit, the average single fiber diameter thereof may be preferably 200 μm or smaller, further preferably 100 μm or smaller.

As a nonwoven fabric for the base material, any of nonwoven fabrics either dry-laid nonwoven fabrics obtained by a spunbonding method, a melt-blowing method, a spunlacing method, a thermal bonding method, a chemical bonding method, an air-laid method, a needle-punching method and the like or wet-laid nonwoven fabrics may be used. Among them, although nonwoven fabrics obtained by a production method in which spinning and sheet formation process are directly coupled, such as a spunbonding method and a melt-blowing method, are preferable from the viewpoint of high strength and advantage in cost, wet-laid nonwoven fabrics are excellent in terms of strength, denseness and uniformity. Accordingly, as a base material for supporting a nanofiber layer, a wet-laid nonwoven fabric is particularly preferably used in the present invention.

As a woven fabric constituting the base material, a textile having a weave structure such as a plain weave, a twill weave or a satin weave from a filament yarn or a spun yarn may be used. The type of the woven fabric is not particularly limited to a specific one.

In the present invention, the type of fibers constituting a nonwoven fabric or woven fabric for the base material is not particularly limited to a specific one. The fiber may be preferably a hydrophilic fiber from the viewpoint of adhesion with the extra-fine fiber layer. Examples of the polymer of hydrophilic fibers may include a polyvinyl alcohol polymer, a cellulose derivative such as a regenerated cellulose and a cellulose acetate; a polyethylene/vinyl alcohol-series and a polyacrylonitrile-series polymer. Further, even usual hydrophobic fibers, those having a coating layer of a hydrophilic polymer such as a polyvinyl alcohol formed on the surface layer by conjugate spinning or the like, are included in the hydrophilic fibers in the present invention. The nonwoven fabric or woven fabric for a base material layer may not be comprised solely of hydrophilic fibers, but may contain, for example, 10% by mass or more, preferably 20% by mass or more of hydrophilic fibers (based on total fibers) to make the property of nonwoven or woven fabric hydrophilic.

Among the above-mentioned polymers, fibers obtained from a polyvinyl alcohol polymer, are preferable as fibers for the nonwoven fabric or woven fabric constituting the base material because those fibers are excellent in strength properties. In particular, nonwoven fabrics obtained from polyvinyl alcohol-based polymer fibers by a wet-laid method are preferable as a support layer in terms of strength, denseness and uniformity. In this case, the average single fiber diameter of polyvinyl alcohol-based fibers constituting the obtainable nonwoven fabric is in a range of 1 to 500 μm, preferably in a range of 1 to 300 μm, further preferably in a range of 3 to 100 μm.

For lamination between the extra-fine fiber layer and the base material, both an extra-fine fiber layer sheet and a base material may be separately formed beforehand, and then they are laminated with each other. Alternatively, an extra-fine fiber layer may be deposited on a base material layer formed beforehand. A nonwoven fabric as a base material layer formed by a spunbonding method or a melt-blowing method in a nonwoven fabric production step may be successively fed to an electro-spinning step without being wound so as to deposit and laminate extra-fine fibers on the nonwoven fabric. Further, onto a laminate comprising of extra-fine fiber layer/base material laminated as described above, a base material layer may be further overlapped to give a three-layer structure of base material layer/extra-fine fiber layer/base material layer. As a structure of the laminate including an extra-fine fiber layer and a base material, there may be mentioned not only the three-layer structure, but also structures such as a five-layer structure of base material layer/extra-fine fiber layer/base material layer/nanofiber layer/base material layer and further a seven-layer structure.

The thickness of the laminate can also be adjusted to a desired thickness by hot pressing or cold pressing as necessary. Then, the layers of the laminate may be bonded by embossing or thermal bonding using a calendar. In this case, bonding may be performed by chemical bonding or the like by spreading a hot-melt adhesive, an emulsion-type adhesive or the like between the nanofiber layer and the base material.

If necessary, without impairing the object and effect of the present invention, a plasticizer, an antioxidant, a slip additive, an ultraviolet absorber, a light stabilizer, an antistatic agent, a flame retardant, a lubricant, a crystallization speed retarder, a colorant and the like may be added to an ethylene-vinyl alcohol copolymer or the like that is suitably used as the polymer (A as well as a polymer of a raw material for a base material. Further, a surface of extra-fine fibers or a surface of base material fibers may be treated with a liquid containing the above-mentioned additive(s).

The present invention will be described in more detail below by way of Examples, but the present invention is in no way limited to these Examples. In Examples below, the physical property values are measured by the following methods. Parts and percentages in Examples are related to mass unless otherwise specified.

[Weight Average Molecular Weight]

Using a gel permeation chromatograph (manufactured by TOSOH CORPORATION) equipped with a column ("TSKgelGMHHR-M" and "TSKgelG2000HHR" manufactured by TOSOH CORPORATION) and a differential refractometer ("RI-8020" manufactured by TOSOH CORPORATION), a weight average molecular weight (Mw) of a polymer was determined in terms of polystyrene as for an ethylene-vinyl alcohol copolymer in DMSO solvent and as for a polyamide in formic acid solvent at 40° C.

[Average Fiber Diameter: nm]

From an enlarged photograph of cross section of nonwoven fabric constituent fibers photographed at a magnification of 5,000 with a microscope (scanning electron microscope; "S-510" manufactured by Hitachi, Ltd.), fiber diameters of 20 fibers selected at random, were measured so that an average value thereof was defined as an average fiber diameter.

[Number of Beads Generated: Number/100 $\mu m^2$]

From an enlarged photograph of cross section of nonwoven fabric constituent fibers photographed at a magnification of 5,000 with a scanning electron microscope ("S-510" manufactured by Hitachi, Ltd.), an area of 10 μm×10 μm was selected at random, and a number of beads observed in the area was defined as a number of beads generated. A nodule-like part having a size equal to or more than 5 times as large as the average fiber diameter was considered as a bead.

[Droplet Absorption Time (Seconds)]

A drop (0.02 mL) of pure water was placed onto the center of 3 cm square of a sheet, and then a time, at which the droplet was absorbed by the sheet and no longer visually observed, was recorded as a droplet absorption time.

[Peel Resistance]

A masking tape is stuck on an aluminum foil, and a nanofiber layer is formed thereon.

Evaluation was performed as follows: peel resistance is satisfactory (Good) when a part of a nanofiber layer on the aluminum foil is not peeled off together with the part of the nanofiber layer on the tape at the time of peeling off the masking tape; and peel resistance is poor (Poor) when a part of a nanofiber layer on the aluminum foil is peeled off together with part of the nanofiber layer on the tape at the time of peeling off the masking tape.

EXAMPLE 1

(1) A spinning dope was prepared by dissolving an ethylene-vinyl alcohol copolymer having an ethylene content of 48% by mole, a saponification degree of 99.9% and a weight average molecular weight of 10,000 as the polymer (A) and a polyethylene oxide having a weight average molecular weight of 1,000,000 as the polymer (B) with stirring in DMSO at 25° C. so as to give polymer concentrations of 18% and 0.0025%, respectively. The weight average molecular weight of the polymer (B) in this case was 100 times as large as the weight average molecular weight of the polymer (A), and the composition ratio of the polymer (A) to the polymer (B) was 7200:1.

(2) The spinning dope obtained in the procedure of (1) was subjected to electro-spinning. A needle having an inner diameter of 0.9 mm was used as a spinneret, and the spinneret was placed above a device for capturing a forming web or sheet at a distance between the spinneret and the device of 8 cm. The capturing device wound a wet nonwoven fabric of polyvinyl alcohol fibers as a base material layer. While an application voltage of 20 kV was applied to the spinneret, the spinning dope was extruded from the spinneret at predetermined feed rate to deposit an extra-fine fiber layer onto the nonwoven fabric moving with a stacking conveyor at a speed of 0.1 m/min to obtain a laminate fiber sheet. The results are shown in Tables 1 and 2.

(3) The obtained fiber sheet was free from "beads", made entirely of fibrous materials, and had an average fiber diameter of 180 nm. An electron microscope photograph of the obtained fiber sheet is shown in FIG. 1. The obtained sheet was excellent in liquid absorbability.

(4) Alternatively, a nanofiber layer was deposited onto an aluminum foil, on which a masking tape was partially stuck, provided as a base material layer instead of the polyvinyl alcohol nonwoven fabric to obtain an extra-fine fiber sheet. The extra-fine fiber sheet thus obtained had satisfactory peel resistance.

EXAMPLE 2

(1) A spinning dope was prepared in the same manner as in Example 1 except that the concentrations of the polymer (A) and the polymer (B) in the spinning dope were changed to 14% and 0.02%, respectively, and that the composition ratio of the polymer (A) to the polymer (B) was 700:1, and then the spinning dope was subjected to electro-spinning. The results are shown in Tables 1 and 2.

(2) The obtained fiber sheet was free from "beads", made entirely of fibrous materials, and had an average fiber diameter of 60 nm. The obtained sheet was excellent in liquid absorbability.

(3) Alternatively, a nanofiber layer was deposited onto an aluminum foil, on which a masking tape was partially stuck, provided as a base material layer instead of the polyvinyl alcohol nonwoven fabric to obtain an extra-fine fiber sheet. The extra-fine fiber sheet thus obtained had satisfactory peel resistance.

EXAMPLE 3

(1) A spinning dope was prepared in the same manner as in Example 1 except that the concentrations of the polymer (A) and the polymer (B) in the spinning dope were changed to 10% and 0.1%, respectively, and that the composition ratio of the polymer (A) to the polymer (B) was 100:1, and then the spinning dope was subjected to electro-spinning. The results are shown in Tables 1 and 2.

(2) The obtained fiber sheet was free from "beads", made entirely of fibrous materials, and had an average fiber diameter of 80 nm. The obtained sheet was excellent in liquid absorbability.

(3) Alternatively, a nanofiber layer was deposited onto an aluminum foil, on which a masking tape was partially stuck, provided as a base material layer instead of the polyvinyl alcohol nonwoven fabric to obtain an extra-fine fiber sheet. The extra-fine fiber sheet thus obtained had satisfactory peel resistance.

EXAMPLE 4

(1) A spinning dope was prepared in the same manner as in Example 1 except that the concentrations of the polymer (A) and the polymer (B) in the spinning dope were changed to 5% and 0.5%, respectively, and that the composition ratio of the polymer (A) to the polymer (B) was 10:1, and then the spinning dope was subjected to electro-spinning. The results are shown in Tables 1 and 2.

(2) The obtained fiber sheet was free from "beads", made entirely of fibrous materials, and had an average fiber diameter of 190 nm. The obtained sheet was excellent in liquid absorbability.

(3) Alternatively, a nanofiber layer was deposited onto an aluminum foil, on which a masking tape was partially stuck, provided as a base material layer instead of the polyvinyl alcohol nonwoven fabric to obtain an extra-fine fiber sheet. The extra-fine fiber sheet thus obtained had satisfactory peel resistance.

EXAMPLE 5

(1) A spinning dope was prepared in the same manner as in Example 1 except that the weight average molecular weight of the polymer (B) was changed to 500,000, the concentrations of the polymer (A) and the polymer (B) in the spinning dope were changed to 14% and 0.04%, respectively, and that the composition ratio of the polymer (A) to the polymer (B) was 350:1, and then the spinning dope was subjected to electro-spinning. The results are shown in Tables 1 and 2.

(2) The obtained fiber sheet was free from "beads", made entirely of fibrous materials, and had an average fiber diameter of 180 nm. The obtained sheet was excellent in liquid absorbability.

(3) Alternatively, a nanofiber layer was deposited onto an aluminum foil, on which a masking tape was partially stuck, provided as a base material layer instead of the polyvinyl alcohol nonwoven fabric to obtain an extra-fine fiber sheet. The extra-fine fiber sheet thus obtained had satisfactory peel resistance.

EXAMPLE 6

(1) A spinning dope was prepared in the same manner as in Example 1 except that the weight average molecular weight of the polymer (B) was changed to 200,000, the concentrations of the polymer (A) and the polymer (B) in the spinning dope were changed to 14% and 0.01%, respectively, and that the composition ratio of the polymer (A) to the polymer (B) was 1400:1, and then the spinning dope was subjected to electro-spinning. The results are shown in Tables 1 and 2.

(2) The obtained fiber sheet was free from "beads", made entirely of fibrous materials, and had an average fiber diameter of 60 nm. The obtained sheet was excellent in liquid absorbability.

(3) Alternatively, a nanofiber layer was deposited onto an aluminum foil, on which a masking tape was partially stuck, provided as a base material layer instead of the polyvinyl alcohol nonwoven fabric to obtain an extra-fine fiber sheet. The extra-fine fiber sheet thus obtained had satisfactory peel resistance.

EXAMPLE 7

(1) A spinning dope was prepared by dissolving a polyamide having a weight average molecular weight of 20,000 with terephthalic acid unit constituting 100% by mole of a dicarboxylic acid unit and a 1,9-nonanediamine unit constituting 50% by mole of a diamine unit and a 2-methyl-1,8-octanediamine unit constituting 50% by mole of the diamine unit as the polymer (A), and a polyethylene oxide having a weight average molecular weight of 1,000,000 as the polymer (B) with stirring in a formic acid solution at 25° C. so as to give polymer concentrations of 16% and 0.0025%, respectively, thereby preparing a spinning dope. The weight average molecular weight of the polymer (B) in this case was 50 times as large as the weight average molecular weight of the polymer (A), and the composition ratio of the polymer (A) to the polymer (B) was 7200:1.

(2) The spinning dope obtained in the procedure of (1) was subjected to electro-spinning. A needle having an inner diameter of 0.9 mm was used as a spinneret, and the spinneret was placed above a device for capturing a forming web or sheet at a distance between the spinneret and the device of 8 cm. The capturing device wound a wet nonwoven fabric of polyvinyl alcohol fibers. While an application voltage of 20 kV was applied to the spinneret, the spinning dope was extruded from the spinneret at predetermined feed rate to deposit an extra-fine fiber layer onto the nonwoven fabric moving with a stacking conveyor at a speed of 0.1 m/min to obtain a laminate fiber sheet. The results are shown in Tables 1 and 2.

(3) The obtained fiber sheet was free from "beads", and made entirely of fibrous materials, and had an average fiber diameter of 180 nm. The obtained sheet was excellent in liquid absorbability.

(4) A nanofiber layer was deposited onto an aluminum foil, on which a masking tape was partially stuck, provided as a base material layer instead of the polyvinyl alcohol nonwoven fabric to obtain an extra-fine fiber sheet. The extra-fine fiber sheet thus obtained had satisfactory peel resistance.

EXAMPLE 8

(1) A spinning dope with the polymer identical to that of Example 7 as the polymer (A) was prepared in the same manner as in Example except that the concentrations of the polymer (A) and the polymer (B) in the spinning dope were changed to 12% and 0.02%, respectively, and that the composition ratio of the polymer (A) to the polymer (B) was 700:1, and then the spinning dope was subjected to electro-spinning. The results are shown in Tables 1 and 2.

(2) The obtained fiber sheet was free from "beads", made entirely of fibrous materials, and had an average fiber diameter of 50 nm. The obtained sheet was excellent in liquid absorbability.

(3) Alternatively, a nanofiber layer was deposited onto an aluminum foil, on which a masking tape was partially stuck, provided as a base material layer instead of the polyvinyl alcohol nonwoven fabric to obtain an extra-fine fiber sheet. The extra-fine fiber sheet thus obtained had satisfactory peel resistance.

COMPARATIVE EXAMPLE 1

(1) A spinning dope was prepared to have a polymer concentration of 25% using only a polymer identical to the polymer (A) of Example 1, and electro-spinning was performed under the same conditions as in Example 1. The results are shown in Tables 1 and 2.

(2) The obtained fiber sheet had an average fiber diameter of 550 nm, and it was difficult to reduce the fiber diameter any more. The obtained sheet did not exhibit sufficient liquid absorbability.

(3) Alternatively, a nanofiber layer was deposited onto an aluminum foil, on which a masking tape was partially stuck, provided as a base material layer instead of the polyvinyl alcohol nonwoven fabric to obtain an extra-fine fiber sheet. The extra-fine fiber sheet thus obtained had poor peel resistance.

COMPARATIVE EXAMPLE 2

(1) As in Comparative Example 1, a spinning dope was prepared to have a polymer concentration of 18% using only the polymer (A) of Example 1, and electro-spinning was performed under the same conditions as in Example 1. The results are shown in Tables 1 and 2.

Figure 2:
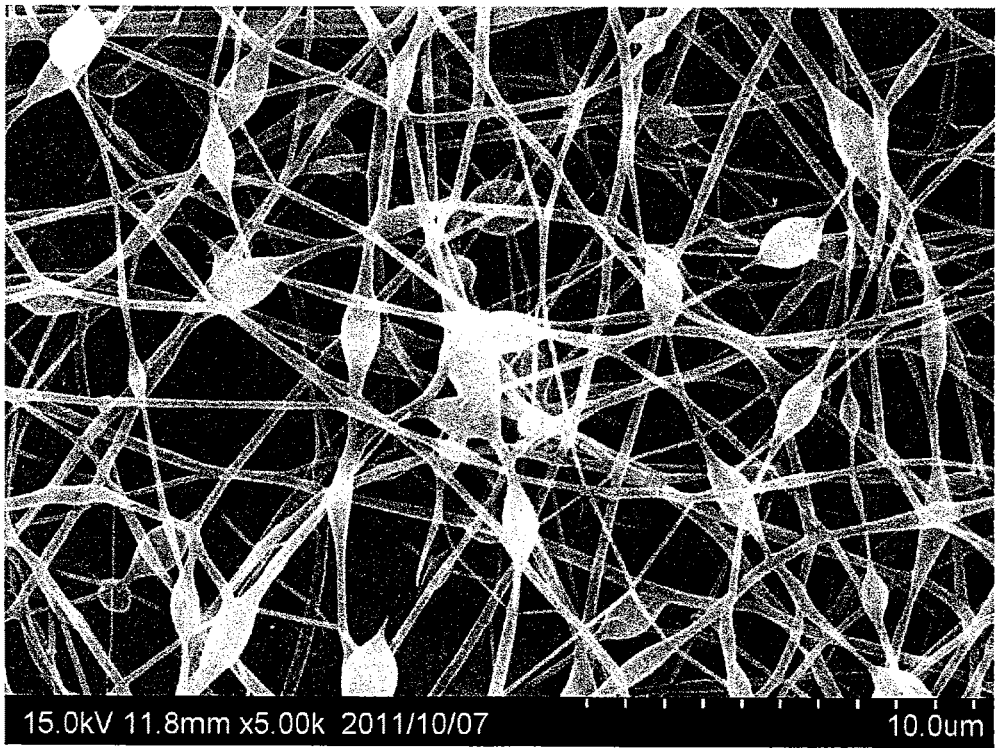
FIG. 2 is a scanning electron microscope photograph (magnification: 5,000) of an extra-fine fiber sheet obtained in Comparative Example 2.

(2) The obtained sheet had at least 6 "beads"/100 $\mu m^2$, and was in a state where beads and fibrous materials were intermingled. An electron microscope photograph of the obtained fiber sheet is shown in FIG. 2.

COMPARATIVE EXAMPLE 3

(1) As in Comparative Examples 1 and 2, a spinning dope was prepared to have a polymer concentration of 5% using only a polymer identical to the polymer (A) of Example 1, and electro-spinning was performed under the same conditions as in Example 1. The results are shown in Tables 1 and 2.

(2) The obtained sheet had no fibrous materials and made entirely of particulate materials.

COMPARATIVE EXAMPLE 4

(1) A spinning dope was prepared in the same manner as in Example 1 except that the concentrations of the polymer (A) and the polymer (B) in the spinning dope were changed to 18% and 0.0015%, respectively, and then the spinning dope was subjected to electro-spinning. The results are shown in Tables 1 and 2.

(2) Since the composition ratio of the polymer (A) to the polymer (B) was 12000:1 and thus the composition ratio of the polymer (A) was excessively high, the obtained sheet had at least 6 "beads"/100 $\mu m^2$, and was in a state where beads and fibrous materials were intermingled.

COMPARATIVE EXAMPLE 5

(1) A spinning dope was prepared in the same manner as in Example 1 except that the concentrations of the polymer (A) and the polymer (B) in the spinning dope were changed to 5% and 0.6%, respectively, and then the spinning dope was subjected to electro-spinning. The results are shown in Tables 1 and 2.

(2) Since the composition ratio of the polymer (A) to the polymer (B) was 8.3:1 and thus the composition ratio of the polymer (A) was excessively low, the obtained sheet had at least 6 "beads"/100 $\mu m^2$, and was in a state where beads and fibrous materials were intermingled.

COMPARATIVE EXAMPLE 6

(1) A spinning dope was prepared in the same manner as in Example 1 except that the weight average molecular weight of the polymer (B) was changed to 50,000, and that the concentrations of the polymer (A) and the polymer (B) in the spinning dope were changed to 18% and 0.0025%, respectively, and then the spinning dope was subjected to electro-spinning. The results are shown in Tables 1 and 2.

(2) Since the weight average molecular weight of the polymer (B) was only 5 times as large as the weight average molecular weight of the polymer (A), the obtained sheet had at least 6 "beads"/100 $\mu m^2$, and was in a state where beads and fibrous materials were intermingled.

COMPARATIVE EXAMPLE 7

(1) A spinning dope was prepared to have a polymer concentration of 0.0025% using only a polymer identical to the polymer (B) of Comparative Example 6, and then electro-spinning was performed under the same conditions as in Example 1. The results are shown in Tables 1 and 2.

(2) The obtained fiber sheet had at least 6 "beads"/100 $\mu m^2$, and was in a state where beads and fibrous materials were intermingled.

COMPARATIVE EXAMPLE 8

(1) A spinning dope was prepared to have a polymer concentration of 23% using only a polyamide having a weight average molecular weight of 10,000 with terephthalic acid unit constituting 100% by mole of a dicarboxylic acid unit and 1,9-nonanediamine unit constituting 50% by mole of a diamine unit and 2-methyl-1,8-octanediamine unit constituting 50% by mole of the diamine unit, and electro-spinning was performed under the same conditions as in Example 1. The results are shown in Tables 1 and 2.

(2) The obtained fiber sheet had an average fiber diameter of 520 nm, and it was difficult to reduce the fiber diameter any more. The obtained sheet did not exhibit sufficient liquid absorbability.

(3) Alternatively, a nanofiber layer was deposited onto an aluminum foil, on which a masking tape was partially stuck, provided as a base material layer instead of the polyvinyl alcohol nonwoven fabric to obtain an extra-fine fiber sheet. The extra-fine fiber sheet thus obtained had poor peel resistance.

TABLE 1

Spinning solution formulation

| Items | | Example 1 | Example 2 | Example 3 | Example 4 | Example 5 |
|---|---|---|---|---|---|---|
| EVAL formulation | Molecular weight | 10,000 | 10,000 | 10,000 | 10,000 | 10,000 |
| | Concentration in solution (wt %) | 18 | 14 | 10 | 5 | 14 |
| 9T formulation | Molecular weight | — | — | — | — | — |
| | Concentration in solution (wt %) | — | — | — | — | — |
| PEO formulation | Molecular weight | 1,000,000 | 1,000,000 | 1,000,000 | 1,000,000 | 500,000 |
| | Concentration in solution (wt %) | 0.0025 | 0.02 | 0.1 | 0.5 | 0.04 |
| EVAL or 9T/PEO formulation | Molecular weight ratio | 1:100 | 1:100 | 1:100 | 1:100 | 1:50 |
| | Solid content ratio (wt:wt) | 7200:1 | 700:1 | 100:1 | 10:1 | 350:1 |

| Items | | Example 6 | Example 7 | Example 8 | Example 9 |
|---|---|---|---|---|---|
| EVAL formulation | Molecular weight | 10,000 | — | — | — |
| | Concentration in solution (wt %) | 14 | — | — | — |
| 9T formulation | Molecular weight | — | 20,000 | 20,000 | 50,000 |
| | Concentration in solution (wt %) | — | 16 | 12 | 10 |
| PEO formulation | Molecular weight | 2,000,000 | 1,000,000 | 1,000,000 | 1,000,000 |
| | Concentration in solution (wt %) | 0.01 | 0.0025 | 0.02 | 0.0025 |
| EVAL or 9T/PEO formulation | Molecular weight ratio | 1:200 | 1:50 | 1:50 | 1:20 |
| | Solid content ratio (wt:wt) | 1400:1 | 7200:1 | 700:1 | 4000:1 |

| Items | | Com. Ex. 1 | Com. Ex. 2 | Com. Ex. 3 | Com. Ex. 4 |
|---|---|---|---|---|---|
| EVAL formulation | Molecular weight | 10,000 | 10,000 | 10,000 | 10,000 |
| | Concentration in solution (wt %) | 25 | 18 | 5 | 18 |
| 9T formulation | Molecular weight | — | — | — | — |

TABLE 1-continued

| Spinning solution formulation | | | | | |
|---|---|---|---|---|---|
| | Concentration in solution (wt %) | — | — | — | — |
| PEO formulation | Molecular weight | — | — | 1,000,000 | |
| | Concentration in solution (wt %) | — | — | 0.0015 | |
| EVAL or 9T/PEO formulation | Molecular weight ratio | — | — | 1:100 | |
| | Solid content ratio (wt:wt) | — | — | 12000:1 | |

| Items | | Com. Ex. 5 | Com. Ex. 6 | Com. Ex. 7 | Com. Ex. 8 |
|---|---|---|---|---|---|
| EVAL formulation | Molecular weight | 10,000 | 10,000 | — | — |
| | Concentration in solution (wt %) | 5 | 18 | — | — |
| 9T formulation | Molecular weight | — | — | — | 10,000 |
| | Concentration in solution (wt %) | — | — | — | 23 |
| PEO formulation | Molecular weight | 1,000,000 | 50,000 | 50,000 | |
| | Concentration in solution (wt %) | 0.6 | 0.0025 | 0.0025 | |
| EVAL or 9T/PEO formulation | Molecular weight ratio | 1:100 | 1:5 | 1:5 | |
| | Solid content ratio (wt:wt) | 8.3:1 | 7200:1 | 7200:1 | |

TABLE 2

| Blow state of extra-fine fiber sheet and fiber diameter | | | | | | | | | |
|---|---|---|---|---|---|---|---|---|---|
| Items | Example 1 | Example 2 | Example 3 | Example 4 | Example 5 | Example 6 | Example 7 | Example 8 | Example 9 |
| State | Fibrous | Fibrous | Fibrous | Fibrous | Fibrous | Fibrous | Fibrous | Fibrous | Fibrous |
| Average fiber diameter (nm) | 180 | 60 | 80 | 190 | 180 | 60 | 180 | 50 | 250 |
| Absorption time (seconds) | 579 | 460 | 283 | 176 | 390 | 538 | 588 | 507 | 566 |
| Peel resistance | Good | Good | Good | Good | Good | Good | Good | Good | Good |
| Items | Com. Ex. 1 | Com. Ex. 2 | Com. Ex. 3 | Com. Ex. 4 | Com. Ex. 5 | Com. Ex. 6 | Com. Ex. 7 | Com. Ex. 8 | |
| State | Fibrous | Beads present | Particulate | Beads present | Beads present | Beads present | Beads present | Fibrous | |
| Average fiber diameter (nm) | 550 | — | — | — | — | — | — | 520 | |
| Absorption time (seconds) | 624 | — | — | — | — | — | — | 800 or greater | |
| Peel resistance | Poor | — | — | — | — | — | — | Poor | |

INDUSTRIAL APPLICABILITY

Since the extra-fine fiber sheet of the present invention includes extra-fine fibers having an average fiber diameter of 500 nm or smaller, such a sheet has a very dense structure.

This extra-fine fiber sheet of the present invention is useful for applications such as those of separators for battery materials, filters, sensors, medical artificial blood vessels, catheters and cell culture media.

Preferred Examples of the present invention have been described above with reference to the drawings, but a person skilled in the art will readily conceive various changes and modifications within obvious ranges by reading the specification of the present application. Therefore, such changes and modifications are construed to fall within the scope of the invention defined from claims.

What is claimed is:

1. An extra-fine fiber sheet comprising an extra-fine fiber assembly, wherein the assembly includes a solvent-spinnable polymer (A) having a weight average molecular weight of 5,000 to 100,000 as a main component and a polymer (B) having a weight average molecular weight equal to or more than 10 times as large as that of the polymer (A) as an accessory component;

the polymer (A) is (i) an ethylene-vinyl alcohol copolymer or (ii) a polyamide including a 1,9-nonanediamine unit, a 2-methyl-1,8-octanediamine unit or both, as a diamine unit;

the polymer (B) is a polyethylene oxide, a polyethylene glycol or a polyacrylamide;

the sheet has a composition ratio of the polymer (A) to the polymer (B) of (A):(B)=10:1 to 10,000:1;

the assembly comprises constituent fibers having an average fiber diameter of 10 to 500 nm; and the assembly has 5 or fewer beads generated per 100 $\mu m^2$ on a cross section of the extra-fine fiber assembly photographed at a magnification of 5,000, and the beads are unfiberized particulate material having a size equal to or greater than 5 times as large as the average fiber diameter.

2. The extra-fine fiber sheet according to claim 1, wherein the polymer (A) is a non-conductive polymer;

the polymer (B) is a thickening polymer; or the polymers (A) and (B) are a non-conductive polymer and a thickening polymer, respectively.

3. The extra-fine fiber sheet according to claim 1, wherein the polymer (A) is the polyamide, and the polyamide comprises a dicarboxylic acid unit and a diamine unit, the dicarboxylic acid unit comprising terephthalic acid unit at a percentage of 60% by mole or more, and the diamine unit comprising 1,9-nonanediamine unit, 2-methyl-1,8octanediamine unit or both at a percentage of 60% by mole or more.

4. The extra-fine fiber sheet according to claim 1, wherein the polymer (B) has a weight average molecular weight of 500,000 or higher.

5. The extra-fine fiber sheet according to claim 1, wherein the extra-fine fiber assembly is an electro-spun fiber.

6. An extra-fine fiber sheet comprising an extra-fine fiber assembly, wherein the assembly consists essentially of:

a solvent-spinnable polymer (A) having a weight average molecular weight of 5,000 to 100,000 as a main component;

a polymer (B) having a weight average molecular weight equal to or more than 10 times as large as that of the polymer (A) as an accessory component; and optionally one or more additives selected from the group consisting of a plasticizer, an antioxidant, a slip additive, an ultraviolet absorber, a light stabilizer, an antistatic agent, a flame retardant, a lubricant, a crystallization speed retarder, and a colorant;

wherein:

the polymer (A) is (i) an ethylene-vinyl alcohol copolymer or (ii) a polyamide including a 1,9-nonanediamine unit, a 2-methyl-1,8-octanediamine unit or both, as a diamine unit;

the polymer (B) is a polyethylene oxide, a polyethylene glycol or a polyacrylamide;

the sheet has a composition ratio of the polymer (A) to the polymer (B) of (A):(B)=10:1 to 10,000:1;

the assembly comprises constituent fibers having an average fiber diameter of 10 to 500 nm; and the assembly has 5 or fewer beads generated per 100 $\mu m^2$ on a cross section of the extra-fine fiber assembly photographed at a magnification of 5,000, and the beads are unfiberized particulate material having a size equal to or greater than 5 times as large as the average fiber diameter.

7. The extra-fine fiber sheet according to claim 1, wherein the assembly comprises constituent fibers having an average fiber diameter of 10 to 400 nm.

8. The extra-fine fiber sheet according to claim 1, wherein the assembly comprises constituent fibers having an average fiber diameter of 10 to 300 nm.

9. The extra-fine fiber sheet according to claim 1, wherein the assembly comprises constituent fibers having an average fiber diameter of 10 to 250 nm.

10. The extra-fine fiber sheet according to claim 1, wherein the sheet has a composition ratio of the polymer (A) to the polymer (B) of (A):(B)=10:1 to 9000:1.

11. The extra-fine fiber sheet according to claim 1, wherein the sheet has a composition ratio of the polymer (A) to the polymer (B) of (A):(B)=10:1 to 8000:1.

12. The extra-fine fiber sheet according to claim 1, wherein the sheet has a liquid absorption such that when a 0.02 mL drop of pure water is placed onto the center of a 3 cm square sheet on an extra-fine fiber assembly side of the sheet, the sheet absorbs the drop of pure water in a time of 700 seconds or less.

13. The extra-fine fiber sheet according to claim 1, wherein the sheet has a liquid absorption such that when a 0.02 mL drop of pure water is placed onto the center of a 3 cm square sheet on an extra-fine fiber assembly side of the sheet, the sheet absorbs the drop of pure water in a time of 600 seconds or less.

* * * * *